United States Patent [19]

Coetzee et al.

[11] Patent Number: 4,842,063

[45] Date of Patent: Jun. 27, 1989

[54] ANCHORING METHOD AND CAPSULE THEREFOR

[76] Inventors: John A. Coetzee, 13 Louw Wepener Street, Alberante, Alberton; Ernest E. Cranko, 12 Beryl Street, Carletonville, both of South Africa; Roger K. Moore, 18 Chandlers Close, Crabbs Cross, Redditch, West Midlands, England, B97 5HU

[21] Appl. No.: 135,770

[22] Filed: Dec. 21, 1987

[30] Foreign Application Priority Data

| | | | |
|---|---|---|---|
| Dec. 30, 1986 | [GB] | United Kingdom | 86.31004 |
| May 5, 1987 | [ZA] | South Africa | 87/3194 |
| Aug. 31, 1987 | [ZA] | South Africa | 87/6480 |
| Dec. 10, 1987 | [GB] | United Kingdom | 87.28475 |

[51] Int. Cl.[4] ..... E21B 33/12; E21D 20/00

[52] U.S. Cl. ..... 166/285; 405/261

[58] Field of Search ..... 166/276, 202, 192, 285; 405/260, 261

[56] References Cited

U.S. PATENT DOCUMENTS

| | | | |
|---|---|---|---|
| 3,940,941 | 3/1976 | Libert et al. | 405/261 |
| 4,412,760 | 11/1983 | Vidal | 405/267 |
| 4,498,817 | 2/1985 | Oalsnam | 405/260 |
| 4,501,515 | 2/1985 | Scott | 405/261 |
| 4,540,316 | 9/1985 | Takahashi | 405/266 |
| 4,659,258 | 4/1987 | Scott | 405/260 |

*Primary Examiner*—Jerome W. Massie, IV
*Assistant Examiner*—Terry Lee Melius
*Attorney, Agent, or Firm*—Caesar, Rivise, Bernstein, Cohen & Pokotilow, Ltd.

[57] ABSTRACT

Loose particulate material A, preferably housed in a capsule C, is urged towards the blind end of a borehole H. An anchor element 1 having an end plate 3 or a head and a disc spaced from the head is driven into the hole with rotation to compact the particulate material to form a load bearing annulus. The material is selected to be of a defined aggregate crushing value.

18 Claims, 4 Drawing Sheets

ANCHORING METHOD AND CAPSULE THEREFOR

The invention relates to anchoring, and in particular to the anchoring of an anchor element in a borehole in a substrate.

It is known to anchor an anchor element in a borehole by means of a sleeve filling the annulus between the element and the wall of the borehole at or near the blind end of the hole. Such sleeves may be preformed of cement or resinous materials and secured to the element before it is received in the hole, and the sleeved element is anchored in the hole using a self setting composition.

In our pending patent application No. (285573) we have described and claimed an anchor element having at the leading end a preformed sleeve of bonded particulate material e.g. silicate bonded sand, the sleeve being located between two end plates on the element. When the element is received in a borehole and the plates are brought closer together, a compressive force is applied to the bonded particulate material to compact it to form a load bearing annulus between the element and the borehole wall.

It has now been discovered that the load bearing annulus may be formed in situ using a supply of particulate material of selected properties. It has also been discovered that an anchor element can be provided with an end adapted for use in the method of forming the annulus in situ.

According to one aspect of this invention there is provided a method of forming a load bearing annulus in a borehole between an anchor element and the wall of the borehole, the annulus comprising compacted particulate material characterised by the steps of locating a supply of particulate material having an aggregate crushing value of from about 6 to about 20 in the borehole, and then subjecting the particles to compression to interlock the particles to form a load bearing annulus.

Our evaluations have shown that the property of aggregate crushing value determines whether particles of a material can be used in this invention. The aggregate crushing value is preferably measured according to British Standard BS 812; Part 3; 1975. In this test, a determination is made of the resistance of the material to a gradually applied compressive load. The weight proportion of fines formed by the compression in the test is calculated and this is the value. Preferably a material for the purpose of this invention has an aggregate crushing value of from about 6 to about 20, preferably about 10. Preferred materials are volcanic in origin, being dense and granular with few natural fracture planes. Specific preferred materials are andalusite, andesite (value of about 9); basalt (value of about 10); dolerite; emery (value of about 8); and flint (value of about 9). The particles will typically measure about 0 to 10 mm in diameter, a mixture of sizes may be used.

The hardness of the material is not relevant because many so-called hard materials have natural planes of weakness in shear and so are not suitable for use in this invention.

While we do not wish to be limited by the following theory, it is postulated that in the method of this invention the particles tend first to slide over each other and then to interlock, so building a series of arches which together define a large arch bridging a gap e.g. an annular gap between the borehole walls or between the anchor element and the facing wall portion. Because of their aggregate crushing value the particles can slide and interlock in this way. If the aggregate crushing value is too low, particles tend to be comminuted and the fine particles formed fill voids between the uncrushed particles but the load bearing properties are inadequate.

Preferably the particulate material is selected from those specified above but other materials such as metal ball bearings can be used, so long as they can be compacted in the manner described without slippage to form an adequate load bearing annulus.

As indicated, the defined particulate material is the essential feature of the invention. In contrast to the earlier application, the particles are loose. The particulate material may contain additives arranged to be activated once the load bearing annulus has been formed. For example, a dry cement powder, setting accelerators, thixotropic agents and the like may be present, and the composition formed may be wetted immediately prior to use so that after the compaction, the cement will set for enhanced properties.

While the supply of the defined particles may be propelled into the borehole as loose particles e.g. using a gun, it is preferred to house the material in frangible capsules e.g. of perforable material especially where there is limited access. Such capsules may be fired using a pneumatic gun or simply pushed up or dropped down the borehole or may be attached to the anchor element when that is placed in the hole.

The capsules may have a wall formed of paper, cardboard, plastics, foil, textiles or the like.

According to one specific aspect of the invention there is provided a method as defined characterised in that a capsule containing the particulate material is propelled towards the blind end of the hole with sufficient force to rupture the capsule and release the contained particulate material and compact the released particulate material.

In one method a capsule is located in a charging gun actuated by compressed air hydraulic or electric power and the gun is fired to propel the capsule towards the blind end of the hole. Preferably the charging gun includes a barrel dimensioned to be received in the gap between the element and the facing wall of the hole and aimed towards the blind end of the hole. In such a case it is a preferred feature of the invention that a plate is present at or adjacent the end of the anchor element located at the blind end of the hole and the capsule of particulate material is propelled towards that plate. Preferably the anchor element is held in the hole by engagement of the edge of the plate with the wall of the hole.

In another specific aspect, the invention provides a method as defined characterised in that a frangible capsule containing the particulate material is placed in the borehole, and the anchor element is then urged into the hole to break open the capsule and release and compact the released particulate material.

In another aspect, the invention provides an anchor element having towards one end a head comprising a plate having a gap formed therein, a disc member longitudinally spaced from the head and along the element, the gap being arranged so that, in use, particulate material located in advance of the element will, upon rotation of the element, be urged through the gap into the volume between the plate and the disc member.

The plate of the head may have more than one gap. The dimensions of the gap will be selected according to the nature of the particulate material to be passed therethrough.

The plate may be a separate item secured to the end of the anchor element or the anchor element and the plate may be integrally formed. A number of plates may be present longitudinally spaced along the element and they may be interconnected as in a spiral or in the manner of an auger.

Preferably the disc member is flexible and takes the form of a washer which is freely movable on the anchor element.

In another more specific aspect, the invention provides a method of anchoring an anchor element as defined above in a borehole, the method comprising the steps of:

urging a supply of particulate material towards the blind end of the hole;

inserting an anchor element as defined above into the hole; and rotating the anchor element so as to draw the loose particulate material from beyond the head into the space between the head and the disc member and compact the particles to form a load bearing annulus.

In another aspect the invention provides a capsule for use in the method characterised in that the capsule contains particulate material having an aggregate crushing value of about 6 to about 20.

The anchor element may comprise a cable or length of bar with or without surface deformations. The element may be made of metal, e.g. steel as in concrete reinforcing bar, glass fibre, carbon fibre, or the like.

The end of the anchor element adjacent the free end of the hole may be threaded or define a hook or otherwise be suitably shaped.

The borehole may have any orientation e.g. upward, downward, vertical or at an angle, or horizontal.

The borehole may be formed in any substrate in which a relatively accurate hole can be formed e.g. drilled, therein. The substrate may be for example a rock, sandstone, concrete, timber or the like.

The invention offers several advantages. The anchor element may be point anchored quickly and efficiently to provide an immediate and high load bearing capacity e.g. up to about 25 tonnes. The element is cheaper and more reliable than an all metal anchor element and can be installed with equal or faster speed to provide a better load bearing. The element can be installed and loaded much more quickly than in the case of a chemically setting system e.g. a resin or cement grout. The metal components of the anchor element can, where necessary, be recovered and reused, e.g. in the case of single side shuttering.

The invention further includes the anchorage formed, as a point anchor or full column anchor, whether stressed or unstressed.

In order that the invention may be well understood it will now be described by way of example only with reference to the accompanying diagrammatic drawings, in which FIG. 1 is a sectional view of an anchor element about to be anchored by a method according to the invention;

Figure 5:
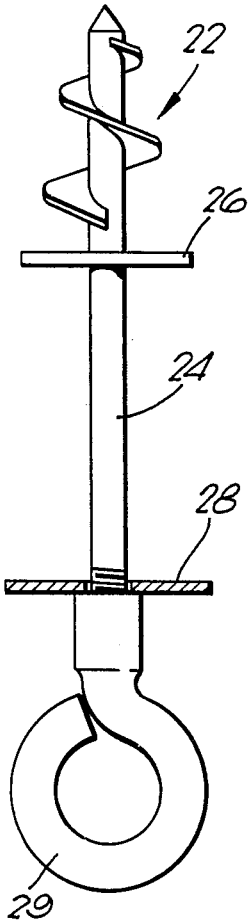
Figure 6:
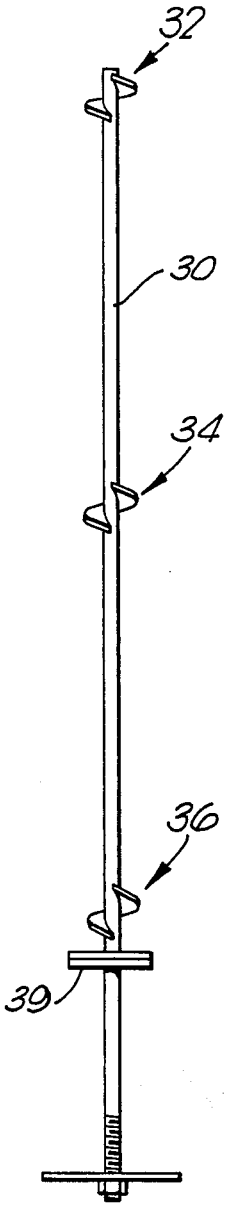
Figure 7:
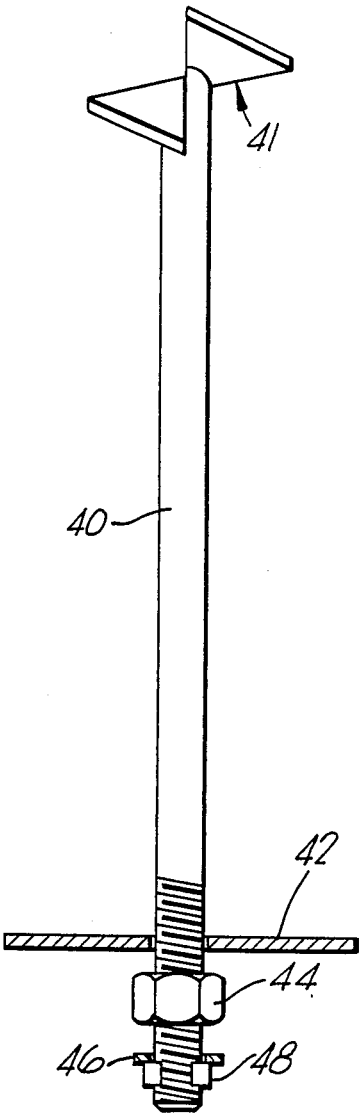
Figure 8:
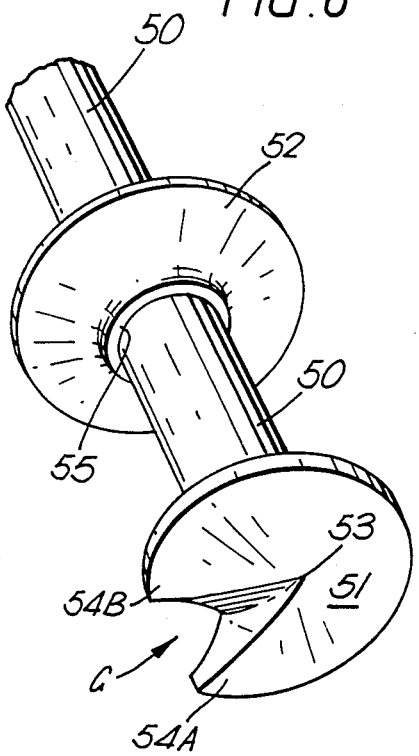
Figure 9:
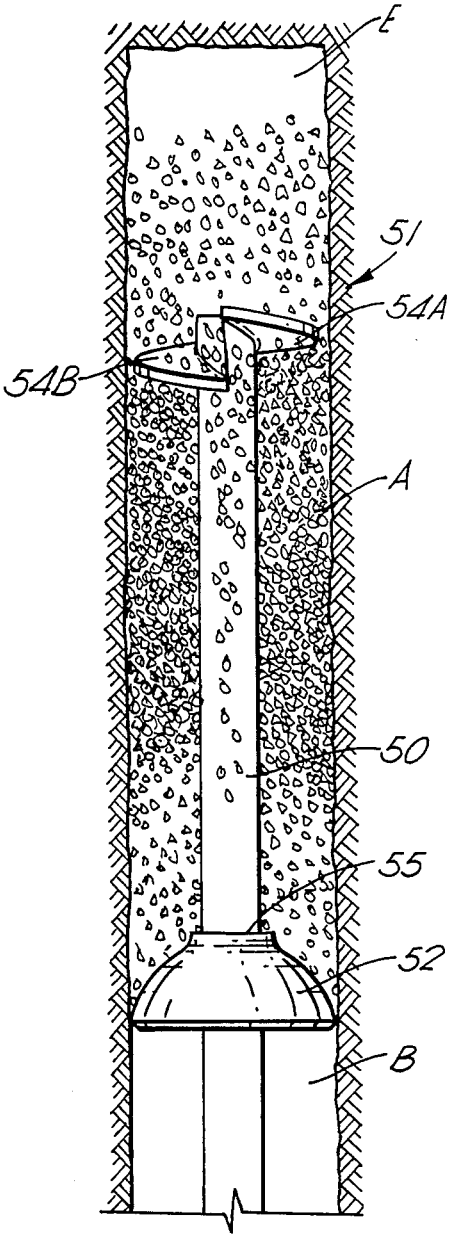

FIGS. 5, 6, and 7 are side elevations of further anchor elements of the invention;

FIG. 8 is a perspective view of one end of another anchor element of the invention; and FIG. 9 is a sectional view showing the element of FIG. 8 at a stage of installation in a bore hole.

Figure 1:
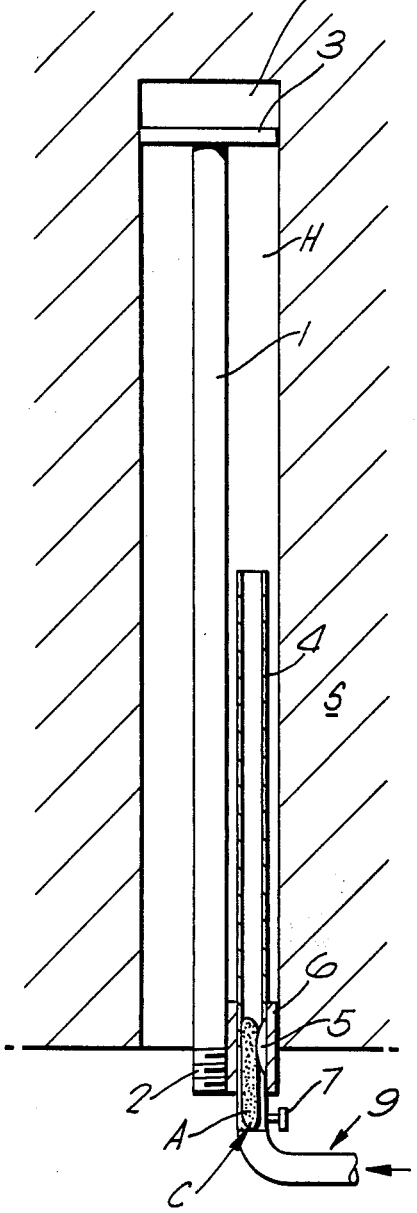
Figure 2:
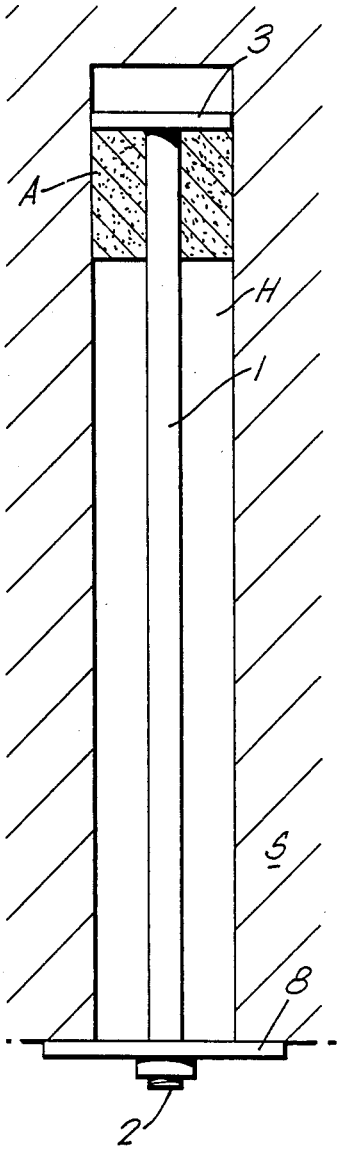
FIG. 2 is a sectional view as FIG. 1 of the anchored condition.

The anchor element in FIGS. 1 and 2 comprises a bolt 1, which may range from 10 cm to about 10 meters in length and from 8 mm to 32 mm in diameter. The bolt 1 is formed of a steel but it may be formed of a strand, rod, wire rope or the like or even a synthetic material, e.g. KEVLAR rope. The lower end 2 is threaded and the threaded length may range from about 10 mm to about 350 mm.

A plate 3 is located at the upper end of the bar and is held there e.g. by welding, forging or by a lock nut, not shown. The bolt 1 is received at the blind end E of a vertical hole H of a substrate S by engagement of the edge of the plate 3 with the wall of the bore hole H.

A pneumatic charging gun G comprises a length of pipe defining a barrel portion 4. The barrel includes a breech 5 and a slide 6 over the breech, and is connected at the distal end of the gun via a valve 7 to a supply of compressed air at a pressure of about 5 to 7 bar.

A capsule C comprises a bag having a wall of paper, woven fabric, perforated plastics, wire or synthetic mesh or the like. The bag is sealed at its ends and includes particles of a compactable material e.g. aggregate A. The aggregate may be volcanic or emery and may have an aggregate crushing value of about 10. The capsule is dimensioned to be received in the barrel of the gun G.

In use, one or more capsules C are loaded in the barrel of the gun G and then barrel 4 is then pushed up the hole H in the gap between the bar 1 and the wall of the hole H. The valve 7 is opened and the compressed air then shoots the capsule up the hole H to the plate 3. The capsule wall breaks open to release the aggregate. The bolt 1 is then rotated and the aggregate is compacted to form an annulus as a point anchor as shown in FIG. 2. As the particles of the aggregate are placed under compression as a result of the rotation of the bolt 1 the particles slide over each other and then interlock, and as the compression increases the degree of interlocking increases with an increase in load bearing properties. The gun G may be used to locate a plurality of such capsules C to form a column of compacted aggregate which will fill the borehole H. The bar may be subjected to an extra pull to improve the compaction of the aggregate. A plate 8 may be secured to the lower end of the bar 1.

Figure 3:
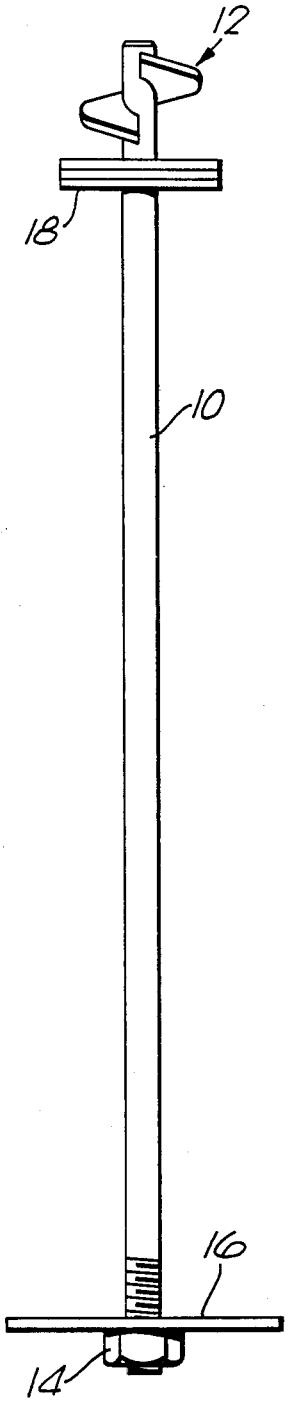
FIG. 3 is a side elevation of another anchor element of the invention.

The anchor element shown in FIG. 3 comprises a high tensile steel rod 10 which is threaded at one end and has a head 12, a lock nut 14, a metal washer plate 16 and a sliding rubber washer 18. The head 12 comprises a forged auger which is welded or screwed to the rod 10. The outside diameter of the auger is slightly smaller than the diameter of the bore hole in which the anchor element is to be received. The sliding washer 18 comprises three rubber washers which are a friction fit on the rod 10. (The number of washers is not critical). The outer diameter of the washers is slightly larger than the hole diameter.

The nut 14 is locked to the threaded end of the bolt in any cnvenient manner such as by upset threads on the nut or rod until a predetermined torque between the nut and rod releases the lock to enable the nut to travel on the threads. The washer 18 is freely movable on the rod 10.

In use, one or more capsules containing particulate material A and of the type shown in FIG. 1 are fed to the blind end of a predrilled hole. An anchor element according to FIG. 3 is urged into the hole until the head 12 is hard up against the underside of the capsule. The resilient washer 18 deforms into the shape of the hole but remains located against the underside of the head 12.

Figure 4:
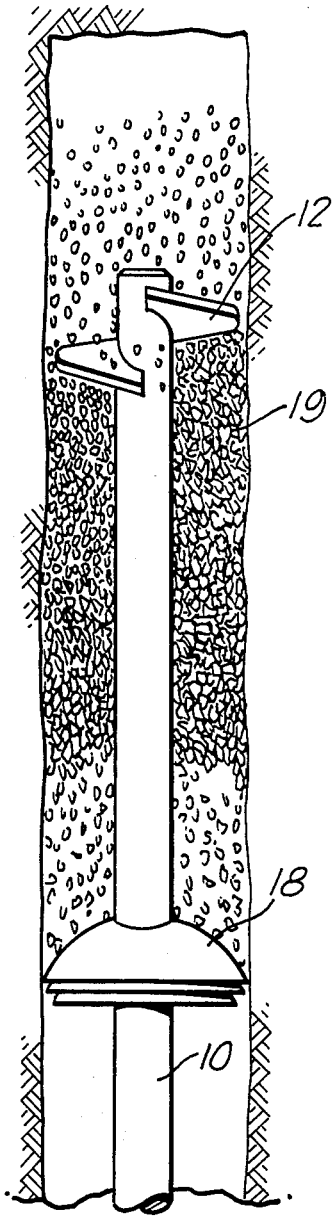
FIG. 4 is a side elevation of the upper end of the anchor element of FIG. 3 received in a hole.

A socket wrench (not shown) which is attached to a suitable drive mechanism is now engaged with the nut 14 and the nut is spun, in this embodiment, in an anti-clockwise direction to advance the auger head 12 into the capsule. As the head 12 advances through the capsule, the particulate material A is fed by the head 12, as illustrated in FIG. 4, down past the head towards the washer 18. The pressure of the particles on the washer forces the washer down the length of the rod as the auger head moves up the hole through the particles until the compacted particles (dark zone in FIG. 4) jam the head and rod in the hole by the compaction of the particles on themselves, the side of the hole, the rod 10 and its head 12. The particles above the head 12 and immediately above the washer 18 are uncompressed with the washer 18 serving merely as a plug to prevent them from dribbling from the hole.

It is important that the thread directions of the auger and thread on the opposite end of the rod are the same. As the rod is jammed by the compacted particles in the hole the torque between the nut 14 and the rod 10 increases until the lock on the nut is broken and the nut advances on the thread until it drives the washer plate 16 against the face of the substrate and is pulled up against the plate to hold the rod in tension between the plate and the jammed portion of the rod. The tension on the rod ensures that the particles in the jammed zone remain compacted to maintain the anchor.

Experiments with the anchor of FIG. 3 have shown that because the compacted particles jam the rod 10 so efficiently, a careful balance must be drawn between the nature of the thread on the end of the rod and the slip torque of the device used to draw up the nut 14 to prevent the threads on the rod, nut, or both, from stripping.

The anchor of FIG. 5 includes an auger head 22 which is longer that that of the FIGS. 3 and 4 and is intended for the location of hanger rings, hooks and the like in rocks and masonry. The rod 24 is shorter and the washer 26 is a single rubber washer and the plate 28 is a metal plate. The free end of the rod 24 is threaded to receive a hanger ring 29, a hook or whatever needs to be anchored. The ring 29 is initially locked by any suitable means to the free end of the rod 24.

The anchor of FIG. 5 is anchored in a hole in the same manner as that of FIG. 3. The anchor is screwed into the capsule by merely placing a bar through the eye of the ring 29 and rotating it by hand until the ring 29 unlocks on the threaded end of the rod and the washer 28 is pulled up against the hole face by the ring 29.

The element of FIG. 6 is employed where full column anchoring is required. The blind end of the hole is loaded with one or more capsules C which are followed by dampened cementitious or resin capsules. The bolt 30 is rotated into the hole with the auger head 32 leading and then the heads 34 and 36 being screwed through and mixing the contents of the settable material capsules until the leading head 32 compacts the particles to form a load bearing annulus to anchor that head and rod 30 in the blind end of the borehole. The rod 30 carries a resilient plug washer 39 to hold the settable material in the hole until it has cured. The plate washer and nut at the free end of the rod 30 function as in the FIG. 3 embodiment.

The rod 30 could carry more or less heads as the application of the anchor element may require. The augers 34 and 36 are shown with the same thread direction as that of the auger head 32. This is, however, not necessarily so, and one or more or all of the auger heads below the head 32 drive the settable material upwardly in the hole as the heads pass through the material. The auger heads below the tip auger 32 may also be of a smaller diameter than the point anchoring auger 32.

The anchor element of FIG. 7 is for use as a rock anchor and includes a threaded rod 40, a head 41, a roofing washer 42, a nut 44 which is free running on the rod threads, a small free washer 46, and swages 48 which are punched into the rod adjacent its free end. The head 41 is in the form of an auger and is formed by upsetting and forging the end of the rod. In use, a predrilled hole is filled with capsules C. The nut 44 is run down the rod thread to jam the washer 46 up against the swages 48 and the rod is spun into the hole in a direction which holds the nut against the washer 46 and causes the head 41 to advance its way through the encapsulated material in the hole. When the rod is located in the hole the nut spinning machine is reversed to drive the washer 42 against the hole face and the nut against the roof washer 42 and to tension the rod. The head 41 could be of any shape which is capable of boring through the material in the hole to compact the particles and the washer 46, although useful to prevent the nut from binding and locking onto the swages while the rod is being spun at high torque into the hole, could be omitted.

The anchor element of FIGS. 8 and 9 comprises a length of steel 50 or the like having at its leading end a head 51 and a flexible disc like washer 52 spaced a short distance from the head 51. The head 51 comprises a generally circular metal plate secured e.g. by welding to the end of the steel length. The diameter of the plate is slightly less than that of the borehole B to receive the anchor element. The plate has a radially inwardly extending tear or cut 53 and the opposite edge portions 54A, 54B, of the cut are bent respectively up and down out of the horizontal plane of the plate 51 so that a gap G is formed. The gap G is dimensioned so that particles of the aggregate A can pass therethrough. The included angle of the gap G in the vertical direction is about 60°.

The flexible washer 52 comprises an annulus of rubber or fibre reinforced plastics or the like which in the relaxed condition is of frustoconical form, the inner edge 55 gripping the surface of the element 50. The diameter of the sleeve is substantially equal to that of the borehole B.

In use, particulate material in a capsule, not shown, is supplied to the blind end E of the borehole, e.g. by being propelled there using a pneumatic gun. The steel length is then urged up the hole towards the capsule and is rotated by means not shown as it advances. As the head 51 contacts the capsule, it starts to break the capsule wall and release the loose particulate material. The upper edge 54B directs the particulate material to flow through the gap G into the space between the underside of the plate and the top of the flexible disc 52. Continued rotation of the length draws more material into that gap and the particles tend to be drawn closer together to form an annulus of compacted material A bridging the borehole. The annulus so formed will have more resistance than the friction grip of the washer to the steel length and the washer will tend to move down the length so allowing the height of the annulus to be increased and all of the available loose particulate material to be compacted. The plate may have more than one gap G, the size of the gap will be adjusted according to the nature of the particulate material; the plate need not be at the free end of the steel length.

We claim:

1. A method of anchoring an anchor element in a borehole, the method comprising the steps of locating a supply of loose particulate material in the borehole, the material having an aggregate crushing value of from about 6 to about 20 as measured according to British Standard BS812 Part 3; 1975 and being selected from the group consisting of andalusite, andesite, basalt, dolerite, emery, flint, metal balls and other materials having said crushing value, inserting the anchor element into the borehole, and then rotating the element in the borehole to subject the particles of the material to compaction to cause the particles to slide over each other and interlock to form a load bearing annulus between the element and the wall of the borehole.

2. A method according to claim 1 wherein the particulate material has an aggregate crushing value of about 10.

3. A method according to claim 2 wherein the particulate material is of volcanic origin.

4. A method according to claim 1 wherein a supply of loose particulate material is urged into the borehole.

5. A method according to claim 1 wherein the particulate material is located in a frangible capsule which is placed in the borehole.

6. A method according to claim 5 wherein the capsule has a frangible wall formed of wire, plastics or textile material.

7. A method according to claim 5 wherein a capsule containing the particulate material is propelled towards the blind end of the hole with sufficient force to rupture the capsule wall and release the contained particulate material.

8. A method according to claim 7 wherein the capsule is located in a charging gun and the gun is fired to propel the capsule towards the blind end of the borehole.

9. A method according to claim 8 wherein the gun includes a barrel dimensioned to be received in the gap between the element and the facing wall of the borehole and aimed towards the blind end of the borehole.

10. A method according to claim 7 wherein a plate is present at or adjacent the end of the anchor element located at the blind end of the hole and the capsule of particulate material is propelled towards that plate.

11. A method according to claim 10 wherein the anchor element is held in the hole by engagement of the edge of the plate with the wall of the hole.

12. A method according to claim 1 wherein a capsule containing the particulate material is placed in the borehole, and the anchor element is then urged into the hole and rotated to break open the capsule, release the particulate material and then compact the released particulate material.

13. A method according to claim 12 wherein a disc member is present and freely movable along the anchor element.

14. A method according to claim 12 wherein the anchor element has a head comprising a plate having a gap formed therein, a disc member longitudinally spaced from the head and along the element, the gap being arranged so that, in use, particulate material located in advance of the element will, upon rotation of the element, be urged through the gap into the volume between the plate and the disc member and be compacted in that volume.

15. A method according to claim 13 wherein the distal end of the anchor element is threaded in the same direction as the direction of rotation of the anchor element.

16. A capsule for use in anchoring an anchor element in a borehole, wherein the capsule has a frangible wall and contains a particulate material having an aggregate crushing value of from about 6 to 20 as measured according to British Standard BS812 Part 3; 1975 and being selected from the group consisting of andalusite, andesite, basalt, dolerite, emery, flint, metal balls, which particulate material can be released from the capsule by destruction of the wall to allow the released particulate material to be compacted to form a load bearing annulus by which an anchor element may be anchored in a borehole.

17. A capsule according to claim 16 wherein the particulate material has an aggregate crushing value of about 10.

18. A capsule according to claim 17 wherein the particulate material is of volcanic origin.

* * * * *

UNITED STATES PATENT AND TRADEMARK OFFICE

CERTIFICATE OF CORRECTION

PATENT NO. : 4,842,063

DATED : June 27, 1989

INVENTOR(S) : John Anthony Coetzee, et al

It is certified that error appears in the above-identified patent and that said Letters Patent is hereby corrected as shown below:

On the title page, paragraph [56] add to References Cited:

-- FOREIGN PATENT DOCUMENTS

| | | |
|---|---|---|
| 697732 | 12/1980 | U.S.S.R. |
| 1073471 | 02/1984 | U.S.S.R. |
| 1129373 | 03/1982 | U.S.S.R. |
| 1170154 | 07/1985 | U.S.S.R. -- |

Signed and Sealed this

Twenty-third Day of April, 1991

*Attest:*

HARRY F. MANBECK, JR.

*Attesting Officer*

*Commissioner of Patents and Trademarks*